US010575625B2

(12) United States Patent
Senn

(10) Patent No.: US 10,575,625 B2
(45) Date of Patent: Mar. 3, 2020

(54) SYSTEMS AND METHODS ASSOCIATED WITH A CONTAINER HOLDER

(71) Applicant: Kevin Senn, Harris, TX (US)

(72) Inventor: Kevin Senn, Harris, TX (US)

( * ) Notice: Subject to any disclaimer, the term of this patent is extended or adjusted under 35 U.S.C. 154(b) by 0 days.

(21) Appl. No.: 16/031,182

(22) Filed: Jul. 10, 2018

(65) Prior Publication Data

US 2019/0021477 A1 Jan. 24, 2019

Related U.S. Application Data

(63) Continuation of application No. 62/536,025, filed on Jul. 24, 2017.

(51) Int. Cl.
*A45F 5/02* (2006.01)

(52) U.S. Cl.
CPC ..... *A45F 5/021* (2013.01); *A45F 2200/0583* (2013.01)

(58) Field of Classification Search
CPC .... A45F 5/021; A45F 5/02; A45F 2200/0583; A45F 2005/027; A45F 2005/025; A45F 2005/028
USPC ..... 224/197
See application file for complete search history.

(56) References Cited

U.S. PATENT DOCUMENTS

| | | | | |
|---|---|---|---|---|
| 1,383,968 | A | 7/1921 | Perry et al. | |
| 4,828,211 | A | 5/1989 | McConnell et al. | |
| 4,984,722 | A | 1/1991 | Moore | |
| D337,028 | S | 7/1993 | Koorey et al. | |
| 5,328,143 | A | 7/1994 | Koorey et al. | |
| 5,791,617 | A | 8/1998 | Boman et al. | |
| 6,131,779 | A * | 10/2000 | Gendala | A45F 5/02 224/148.1 |
| 6,394,329 | B1 | 5/2002 | Magee | |
| 7,300,031 | B2 * | 11/2007 | Bertsch | A47G 23/0225 224/281 |
| 7,464,907 | B1 | 12/2008 | Lane | |
| 7,744,053 | B2 * | 6/2010 | Perman | A45F 5/02 248/312 |
| 7,784,655 | B2 | 8/2010 | Su | |
| 8,066,148 | B2 | 11/2011 | Garahan | |
| 9,241,554 | B1 * | 1/2016 | Tong | A45C 13/00 |
| 9,295,320 | B1 * | 3/2016 | McManus | A45F 5/021 |
| 9,657,890 | B2 * | 5/2017 | Botello | F16M 13/02 |
| 9,796,316 | B1 * | 10/2017 | Siqueira | B60N 3/106 |
| 2004/0045992 | A1 * | 3/2004 | Dohn | A45F 5/02 224/673 |
| 2004/0251284 | A1 * | 12/2004 | Pelligrini | A45F 5/02 224/198 |
| 2012/0056063 | A1 * | 3/2012 | Shimajiri | B60N 3/102 248/311.2 |
| 2012/0298703 | A1 | 11/2012 | Kriner | |

* cited by examiner

*Primary Examiner* — Derek J Battisti
(74) *Attorney, Agent, or Firm* — Pierson IP, PLLC

(57) ABSTRACT

Embodiments disclosed herein describe systems and methods for a container holder with a smaller profile when in use and not in use.

19 Claims, 11 Drawing Sheets

SYSTEMS AND METHODS ASSOCIATED WITH A CONTAINER HOLDER

BACKGROUND INFORMATION

Field of the Disclosure

Examples of the present disclosure are related systems and methods associated with a container holder. More specifically, embodiments are directed towards a container holder with an internal rotating member and an internal lock.

Background

A water bottle is a container that is used to hold water, liquids, or other beverages for consumption. A water bottle allows an individual to transport and drink a beverage at multiple locations.

Conventionally to transport water bottles, a user can either hold the water bottle in their hand or user a bottle holder. However, holding a water bottle requires one of the user's two hands to carry the water bottler. Situations can arise where it is burdensome for a user to relinquish one of their hands to carry the water bottle.

Alternatively, a user can use a bottle holder to transport water bottles. However, conventional bottle holders are cumbersome and require ample space regardless of if they are in use or not.

Accordingly, needs exist for more effective and efficient systems and methods for a container holder with an internal rotating member and internal lock that are configured to minimize the profile of the container holder.

SUMMARY

Embodiments disclosed herein describe systems and methods for a container holder with a smaller profile. Embodiments of the container holder may include a clip, a body, a rotating member, and locks.

The clip may be positioned on a rear surface of the container holder. The clip may be configured to allow the container holder to be attached and detached from a belt, waistband, etc. The clip may include a projection that extends from an upper surface of the container holder towards a lower surface of the container holder. Responsive to sliding the projection around the belt of the user, the belt may be positioned between the rear surface of the user and the projection.

The body of the container holder may extend from the upper surface to the lower surface. The body may include a cutout, rails, and lock orifices.

The cutout may be positioned on a lower half of the body between two rails. In embodiments, when the rotating member is in a first position, the rotating member may be positioned with the cutout.

Internal surfaces of the rails may include first locking grooves and locking lip. The first locking grooves may be configured to receive the locks when the rotating member is in the first position. The locking lip may be a notch extending from a front surface of the rails into the first locking groove, wherein the locking lip is configured to receive the locks when the rotating member is in the second position. The lock orifices may be positioned through the rails and the locking grooves, and may be configured to secure the locks in place. The lock orifices may be configured to allow the locks to be positioned within and outside of the first locking grooves.

The rotating member may be configured to rotate between a first position and a second position. In the first position, the rotating member may be positioned within the cutout and extend in a direction that is in parallel within the body. In the second position, the rotating member may extend away from the body in a direction that is perpendicular to the body.

The rotating member may include second locking grooves, a container indentation, and arms.

The second locking grooves may be configured to receive the locks to allow the rotating member to rotate between the first position and the second position.

The container indentation may be an arc, cutout, groove, etc. positioned on a second end of the rotating member, The arc may be configured to receive a neck of the container to secure the container in place. The arc may include bumps, notches, etc. which are configured to increase the surface area of the arc to provide better stability to the container. The arms may be positioned between sidewalls of the rotating member and the arc, wherein the arms are configured to grasp or hold the container neck in place. The arms may include cutouts that are configured to allow the arms to compress and expand to accommodate necks of bottles of different shapes and/or sizes.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
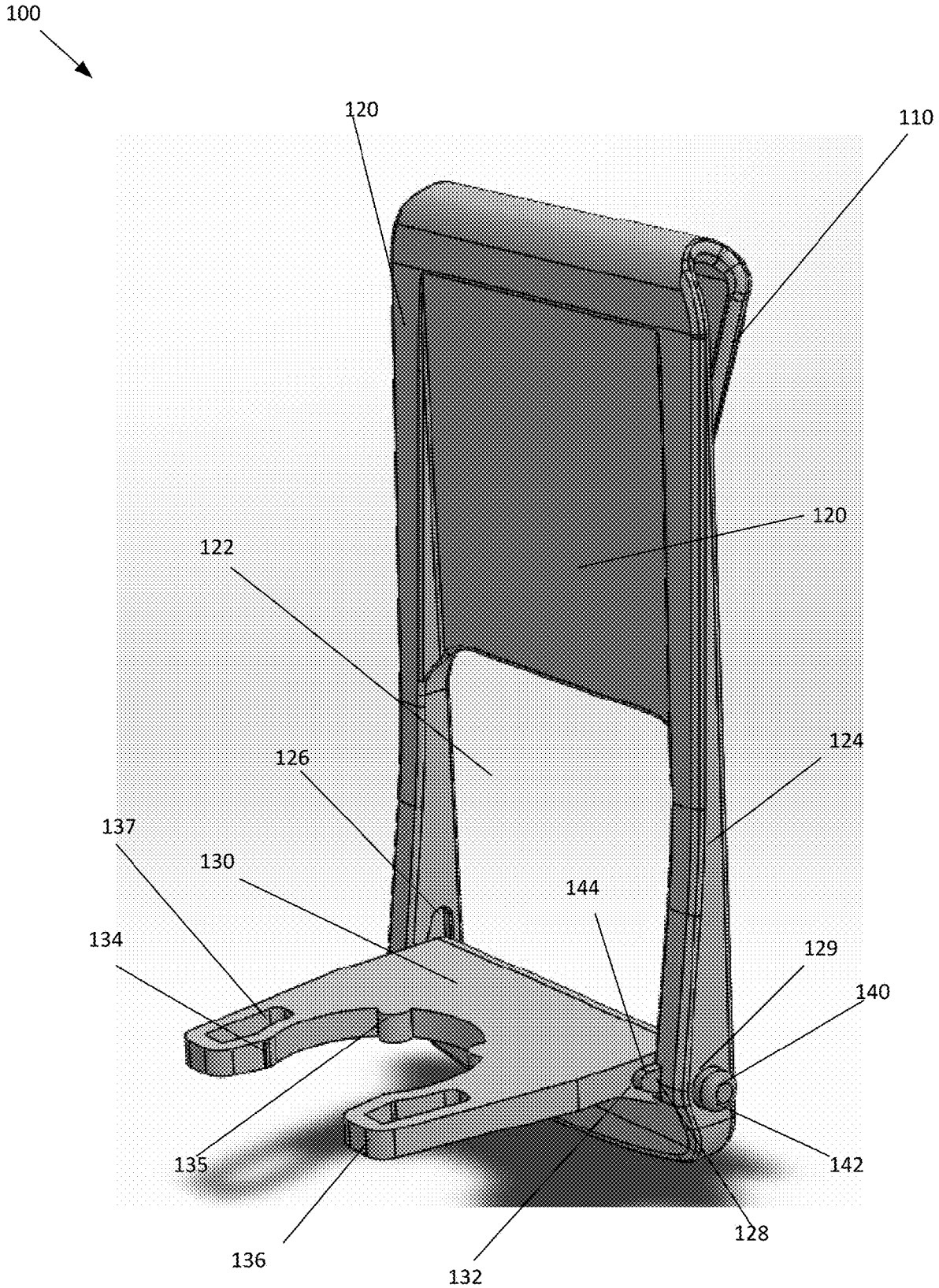
FIG. 1 depicts a container holder, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts a container holder 100 with a small profile, according to an embodiment. Embodiments of the container holder may include a clip 110, body 120, rotating member 130, and locks 140.

Clip 110 may be positioned on a rear surface of container holder 100, and be configured to allow container holder 100 to be attached and detached from a belt, waistband, etc. Clip 110 may include a projection that extends from an upper edge of container holder 110 towards a lower surface of the container holder. A first end of clip 110 may be permanently positioned on the upper edge of container holder 100. A second end of clip 110 may be configured to move from a position adjacent to the rear surface of container holder 100 to a position away from the rear surface of container holder 100. Responsive to sliding the projection around the belt of the user, the belt may move the second end of the projection away from the rear surface of container holder 100. Then, clip 110 may apply pressure towards the rear surface of container holder 100. This pressure may secure container holder 100 to the belt.

Body 120 may extend from an upper edge to a lower edge of container holder 100. Body 120 may include cutout 122, rails 124, first locking grooves 126, locking lip 128, and locking orifices 129.

Cutout 122 may be positioned through a lower portion of body 120 between rails 124. Cutout 122 may have substantially the same width and height as rotating member 130, such that when rotating member 130 is in a first position, outer surfaces of rotating member 130 are positioned adjacent to inner surfaces of rails 124.

First locking grooves 126 may be positioned on the internal sidewalls of rails 124 and be configured to receive locks 140 when rotating member 130 is in a first position. First locking grooves 126 may be configured to extend from the lower boundary of rails 124 towards and upper boundary of rails 124. First locking grooves 126 may have substantially the same shape and size as an inner portion of locks 140, such that the inner portion of locks 140 are positioned within firing locking grooves 126 when rotating member 130 is in the first position. By positioning the inner portion of locks 140 within first locking grooves 126, locks 140 may be engage limiting the rotating of rotating member 130.

Locking lips 128 may be a notch extending from a front surface of rails 124 into first locking grooves 126. Locking lips 128 may be configured to receive the inner portions of locks 140 when rotating member 130 is in a second position. This may enable locking lips 128 to secure rotating member 130 in the second position, until a user applied pressure to locks 140 to disengage the locks. such that only a portion of locks 140 are positioned within body 120 in the second position. As such, locking lips 128 may allow a proximal end of locks 140 to protrude away from rails 124 in the second position. Thus, locks 140 to have a length that is greater than that of rails 124, and locking lips 128 may have a shorter length than projections 144 of locks 140, such that when rotating member 130 is in the second position, projections 144 of locks 140 extend across locking lips 128. Locking lips 128 may have a width that is substantially the same as that of locks 140, such that when locks 140 are positioned within locking lips 128, the inner sidewalls of locking lips 128 are positioned adjacent to the outer sidewalls of projections 144.

Locking orifices 129 may be positioned through rails 124 and first locking grooves 126. Locking orifices 129 may be configured to secure locks 140 in place, while allowing locks 140 to move towards and away from a longitudinal axis of the container holder 100. Accordingly, locking orifices 129 may allow a shaft associated with locks 140 to slide in and out of locking orifices 129. This may allow locks 140 to be positioned within locking lips 129, locking grooves 126, or positioned within rotating member 130. More specifically, responsive to pushing, pinching, or otherwise applying pressure against locks 140 towards the longitudinal axis of container holder 100, locks 140 may slide within locking orifices 129, such that the outer sidewalls of locks 140 are positioned planar with rails 124. Responsive to removing the pressure against locks 140 towards the longitudinal axis of container holder 100, locks 140 may slide in an opposite direction within locking orifices 129, such that the outer sidewalls of locks 140 are no longer co-planer with rails 124.

Rotating member 130 may be configured to rotate about an axis defined by locking orifices 129. Rotating member 130 may rotate between a first positioned and a second position when locks 140 are disengaged from first locking grooves 126 and locking lips 128. Further, rotating member 1230 may be secured in place with locks 140 are engaged with first locking grooves 126 or locking lips 128. When rotating member 130 is in the first position, rotating member 130 may be positioned within cutout 122, and extend in a direction that is in parallel to the longitudinal axis of container 100. By positioning rotating member 130 within cutout 122 when rotating member 130 is in the first position, the profile of container holder 100 is not increased by rotating member 130. When rotating member 130 is in the second position, rotating member 130 may extend away from container holder 100 in a direction that is perpendicular to the longitudinal axis of container holder 100. Furthermore, in the second position, a first end of rotating member 130 may be positioned between rails 126. Rotating member 130 may include second locking grooves 132, container indentation 134, and arms 136.

Second locking grooves 132 may be positioned proximate to the first ends of rotating member 130 on the outer surfaces of rotating member 130. Second locking grooves 132 may be substantially symmetrical in shape as first locking grooves 126. Second locking grooves 132 may be configured to receive locks 128 when locks 128 are disengaged from first locking grooves 126 or locking lips 128. When locks 128 are positioned within second locking grooves 132, rotating member 130 may freely rotate between the first position and the second position. Further, when locks 128 are positioned within second locking grooves 132, outer surfaces of projection 144 may be coplanar with the sidewalls of rotating member 130.

Container indentation 134 may be an opening, arc, cutout, groove, etc. position on a second end of rotating member 130. The opening may be configured to receive a neck of a container, water bottle, etc. to secure it in place when rotating member 130 is in the second position. Container indentation 134 may include a plurality of bumps 135, notches, etc., which are configured to increase the surface area of container indentation 134 to provide better stability to the container.

Arms 136 may encompass container indentation 134, and may be configured to apply force against the container to secure the container in place. Arms 136 may include cutouts 137. Cutouts 137 may be positioned between the outer surfaces of arms 136 and container indentation 134 at a distal end of arms 136. Cutouts 137 may be configured to allow arms 136 to compress and expand an inner diameter of a distal end of container indentation 134 to accommodate necks of bottles of different shapes and/or sizes. Further, the positioning of cutouts 137 allows the apex of container indentation 134 to remain at a fixed position. More specifically, cutouts 137 allow a distance between the inner surfaces of arms 136 to vary at locations associated with cutouts 137.

Locks 140 may be aligned with lock orifices 129, and control the rotation of rotating member 130. In embodiments, if locks 140 are engaged, then rotating member 130 may not be able to rotate. If locks 140 are disengaged then rotating member 130 may be able to rotate between the first position and second position. Locks 140 may include an interface 142 and projection 144.

Interface 142 may be a shaft configured to receive external force from a user to disengage locks 140 by moving projection 144 towards the central axis of container holder 100. If the external force is not received from the user, then springs (not shown) or other devices apply forces away from the central axis of container holder 100 to maintain locks 140 in the engaged position.

Projections 144 may be outcrops, protrusions that are configured to be housed within first locking grooves 126 or locking lips 128 when locks 140 are engaged, and within second locking grooves 132 when the locks 140 are disengaged. In embodiments, projections 144 may have a wider length than that of interface 142, such that interface 142 may not restrict the free rotation of locks 140 while projections 144 may restrict the rotation of locks 140. Further, the height of projections 144 may be less than a height of first locking grooves 126 and/or locking lips 128, such that when locks are disengaged an outer surface of projections 144 is coplanar with locking grooves 126 and/or locking lips 128.

Figure 2:
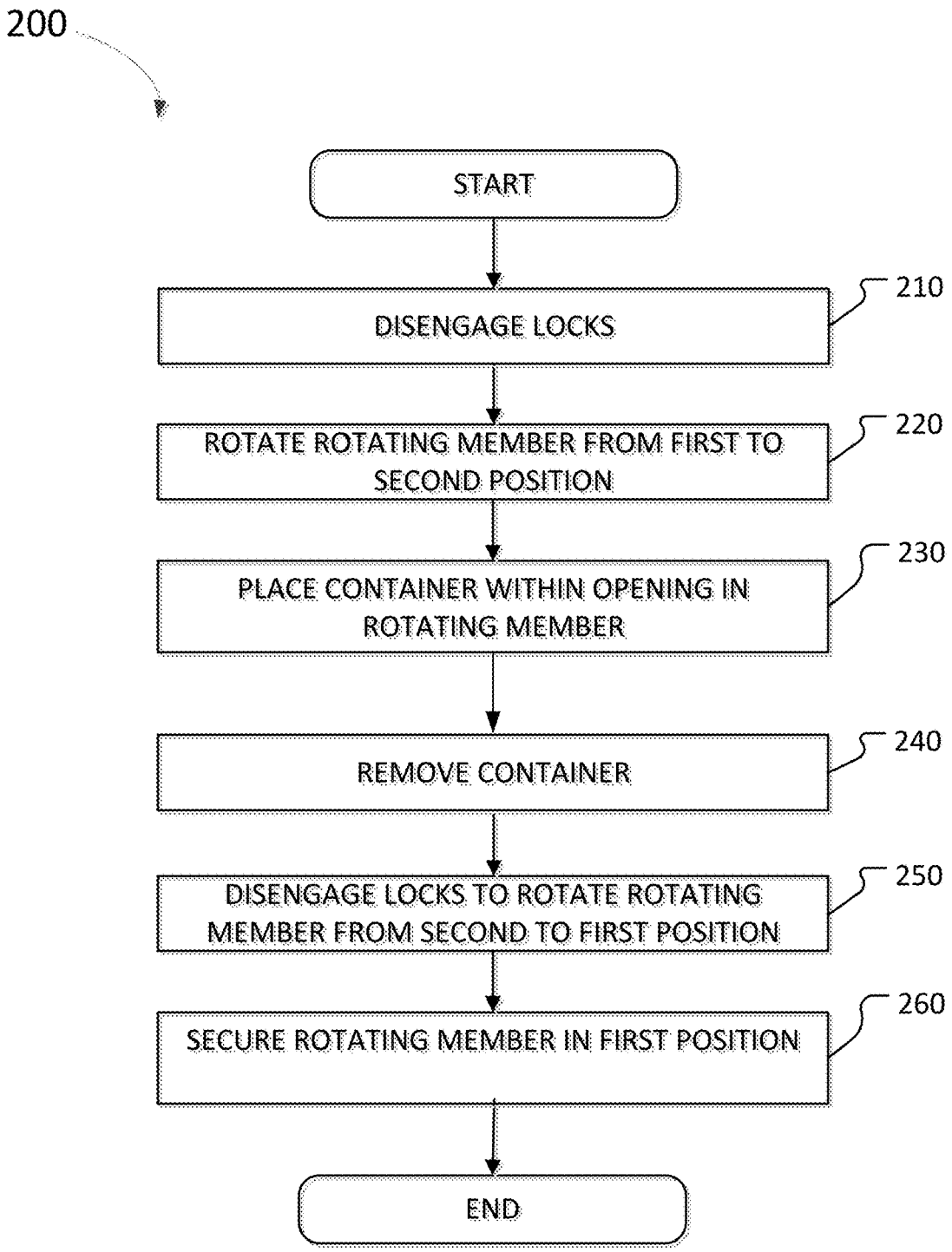
FIG. 2 depicts a method for utilizing a container holder, according to an embodiment.

FIG. 2 depicts a method 200 for utilizing a container holder, according to an embodiment. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting.

At operation 210, a user may apply force against locks in a direction towards a central axis of the container holder to disengage locks. The locks may be disengaged by moving projections from first locking grooves to second locking grooves, wherein the second locking grooves are embedded within a rotating member. The force applied to the locks may be greater than a disengaging force in the opposite direction, wherein the disengaging force may be constantly applied by springs.

At operation 220, the rotating member may be rotated between a first position and a second position while the locks are disengaged. While rotating the rotating member is between the first position and second position, the projections of the locks may remain within the second locking grooves.

At operation 230, the user may no longer apply the force against the locks and the locks may be engaged with locking lips. This may secure the rotating member in a second position. Further, the springs may apply the disengaging force towards the sidewalls of the rails to automatically engage the locks with the engaging lips.

At operation 240, a container may be positioned within an opening within rotating member and secured in place.

At operation 240, the container may be removed from the opening, and the user may once again apply force against the locks in a direction towards the central axis of the container holder to disengage the locks, wherein the force applied by the user is greater than the disengaging force.

At operation 250, the rotating member may be rotated between the second position and the first position while the locks are disengaged.

At operation 260, the rotating member may be fixed in placed in the first position, and the locks may be engaged within the first locking grooves. Further, the springs may apply the disengaging force towards the sidewalls of the rails to automatically engage the locks with the first locking grooves.

Figure 3:
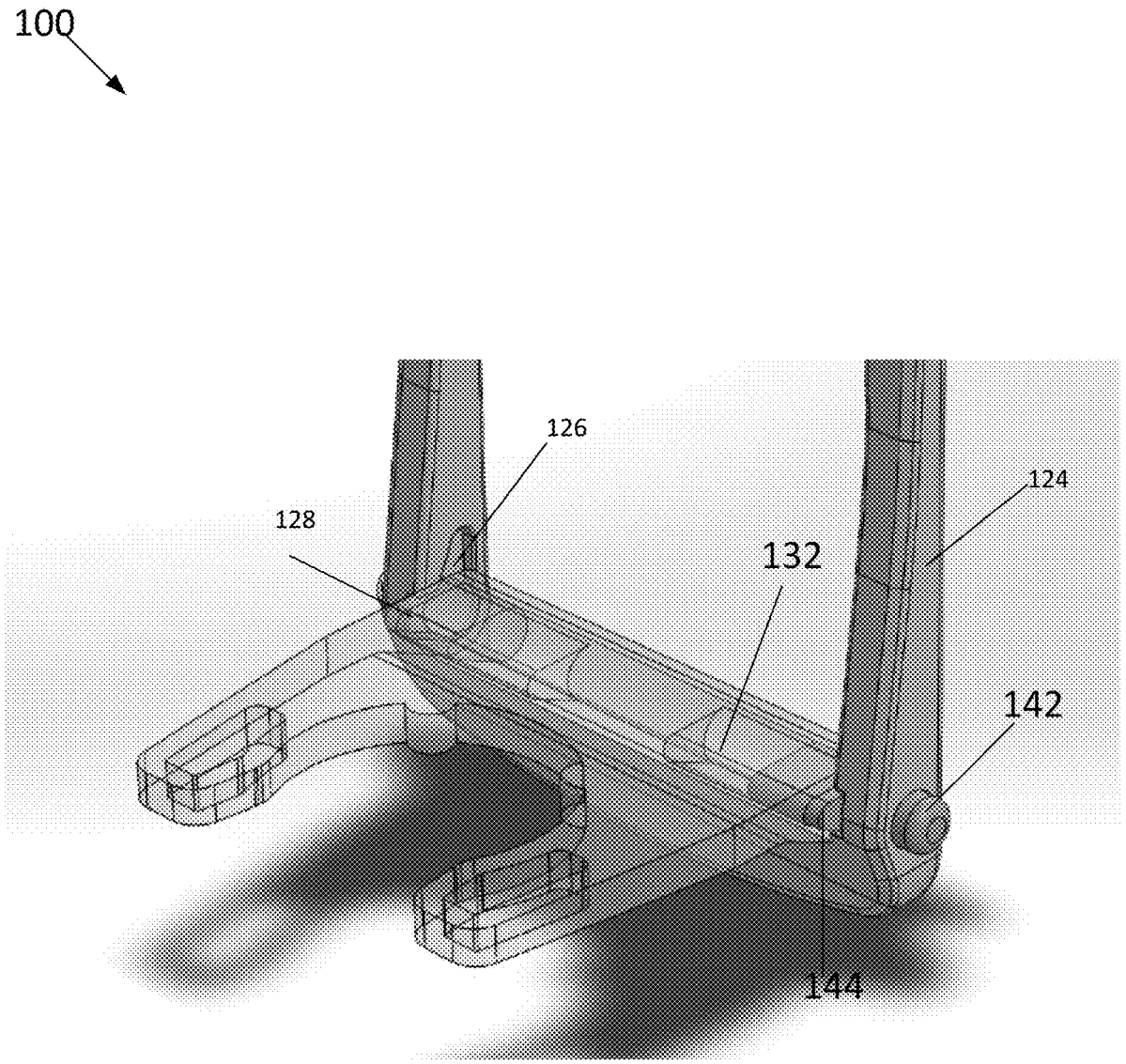
FIG. 3 depicts an internal view of elements of a container holder, according to an embodiment.

FIG. 3 depicts an internal view of elements of container holder 100, according to an embodiment. Elements depicted in FIG. 3 are described above. For the sake of brevity a further description of these elements is omitted.

As depicted in FIG. 3, second locking grooves 132 may include an internal chamber that is configured to receive projections 144 responsive to a user applying pressure against interface 142, wherein interface 142 may include a shaft that extends through rails 124. Responsive to positioning projections 144 within second locking grooves 132, projections 144 will no longer impede the rotation of rotating member 130.

Figure 4:
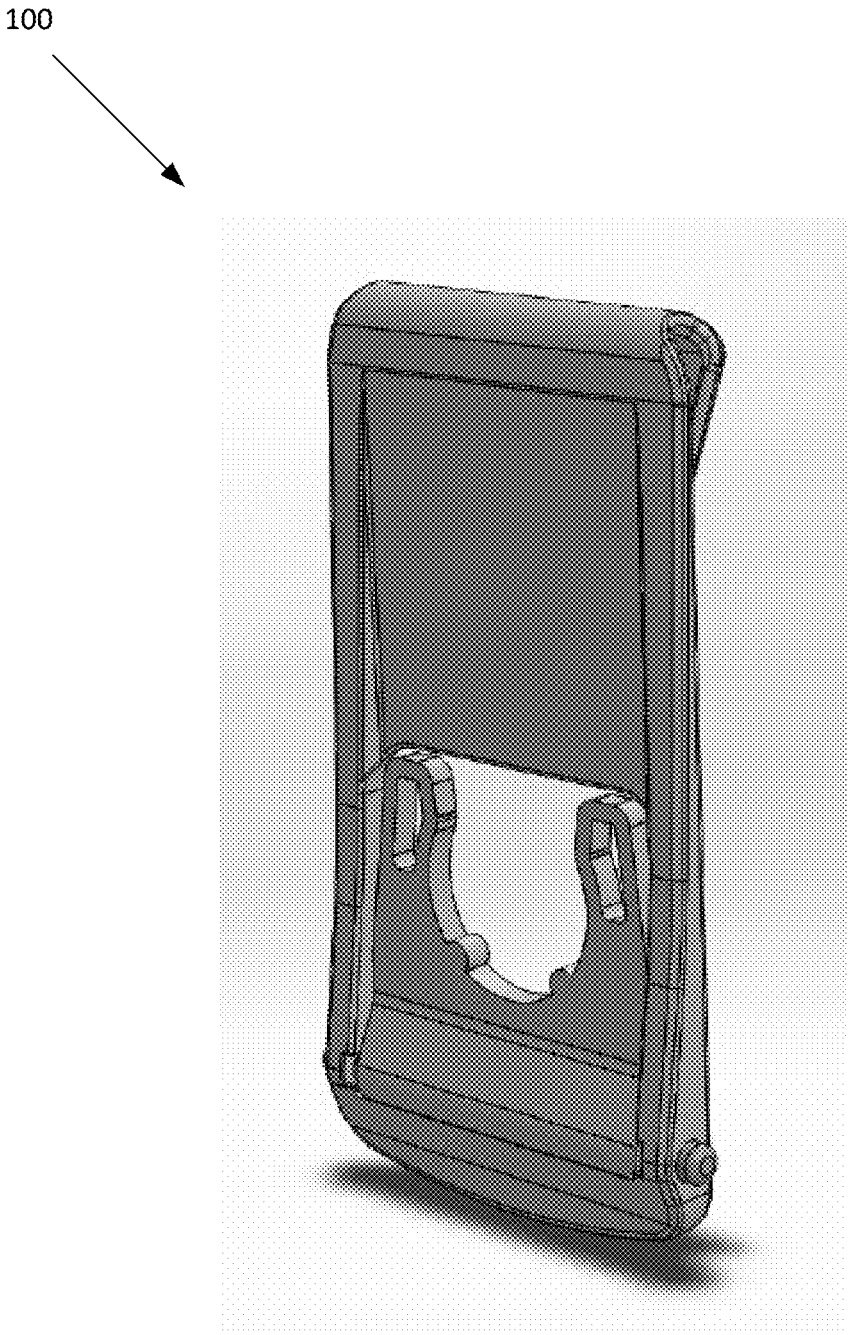
FIGS. 4 and 5 depict various views of a container holder, according to an embodiment.
Figure 5:
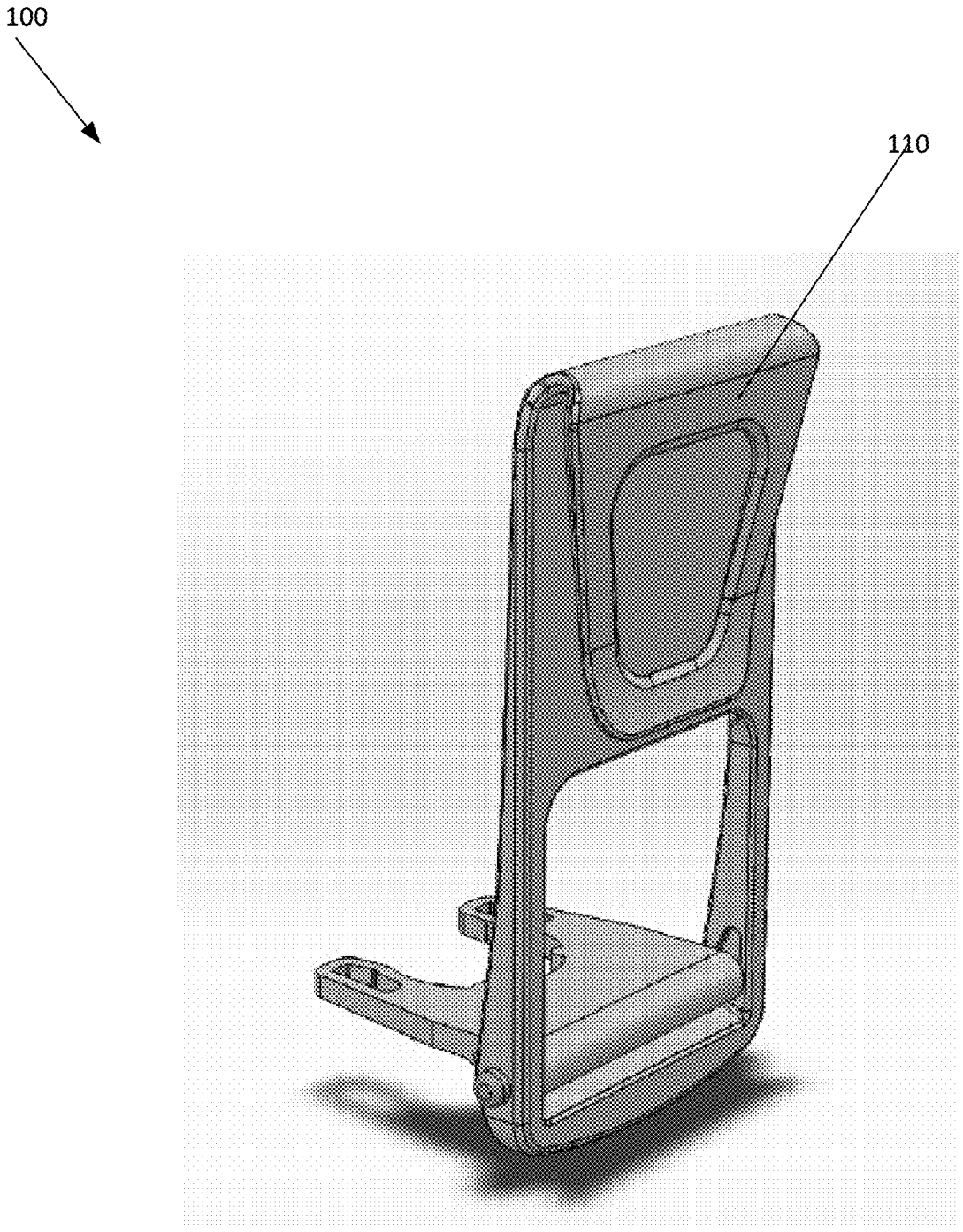

FIGS. 4 and 5 depict various views of container holder 100, according to an embodiment. Elements depicted in FIGS. 4 and 5 are described above. For the sake of brevity a further description of these elements is omitted.

Figure 6:
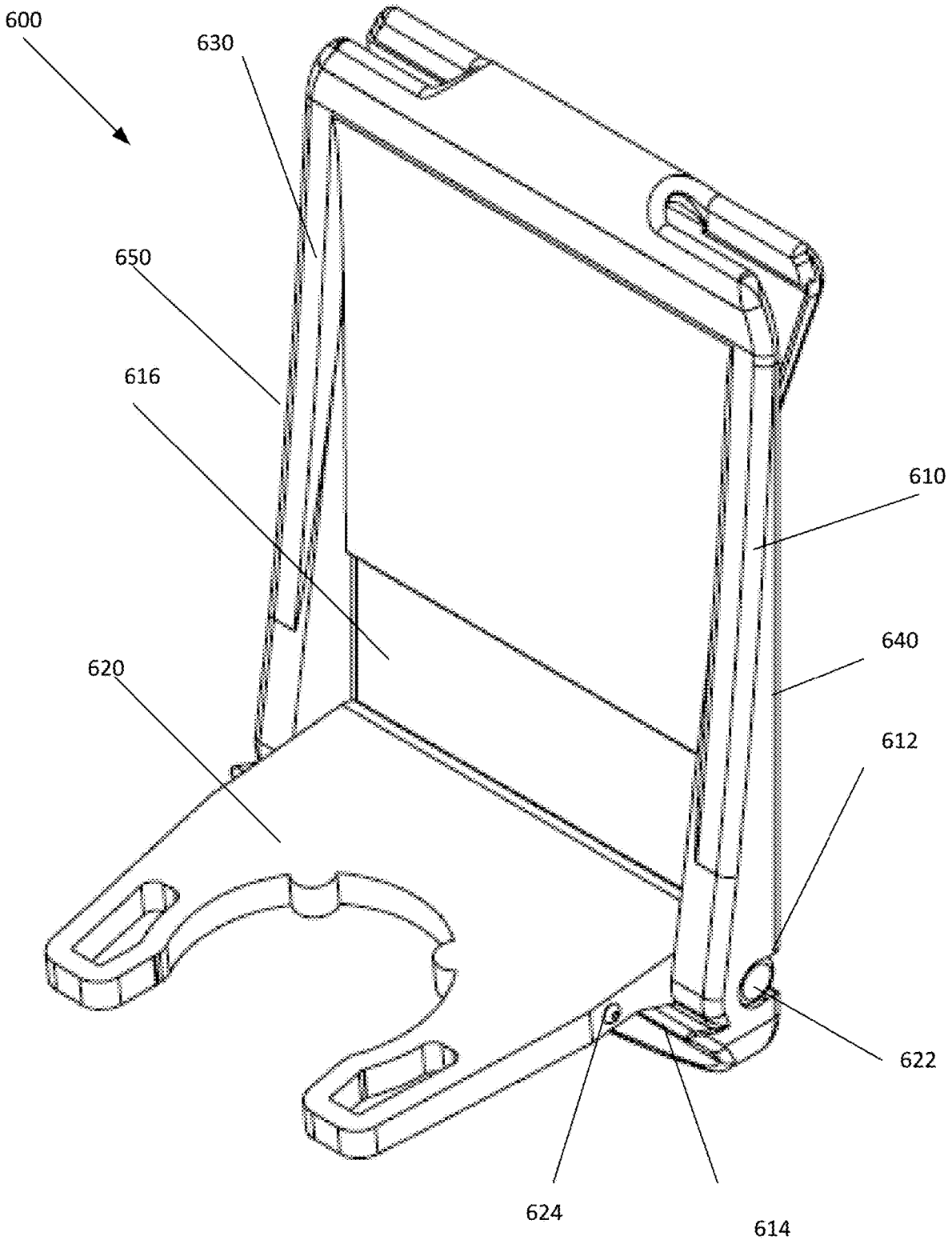
FIGS. 6-16 depict various views of a container holder, according to an embodiment.

FIG. 6 depict various views of container holder 600, according to an embodiment. Elements depicted in FIG. 6 are described above. For the sake of brevity a further description of these elements is omitted.

Container holder 600 may include a base 610 and a rotating member 620.

Base 610 may include rails 630, locking grooves 612, ledge 614, and cutout 616.

Rails 630 may extend along the length of base 610. The rear surface 640 of base 610 may be positioned in parallel to a central axis of base 610. The front surface 650 of base may be sloped to increase a width of rails 630, such that a bottom surface of rails 630 may be larger than a top surface of rails 630.

Rear surface 640 of rails 630 may include locking grooves 612, which are configured to receive projections 622 positioned on rotating member 620. Grooves 612 may be cutouts, orifices, etc. that extend from rear surface 640 towards front surface 650.

Ledge 614 may be positioned on front surface 650 of rails 630, and may be configured to support rotating member 620 when rotating member is in an extended position. In embodiments, ledge 614 may have an upward slope, and extend away from front surface 650 of rails 630. A lower end of ledge 614 may be substantially aligned with a lower end of locking grooves 612, and an upper end of ledge 614 may positioned slightly below a center point of locking grooves. As such, when rotating member 620 is in the extended position, rotating member 620 may be positioned perpendicular to a central axis of container holder 600.

Cutout 616 may be positioned between rails 630. Cutout 616 may be configured to allow a user to apply pressure against a top surface of rotating member 620, when rotating member 620 is in the collapsed position. Accordingly, cutout 616 may assist in the rotating of rotating member 620.

Rotating member 620 may include locking projections 622 and protrusions 624.

Locking projections 622 may be configured to be press fit into locking grooves 612. This may allow rotating member 620 to be temporarily coupled with base 610. Further, locking projections may define an axis of rotating of rotating member 620.

Protrusions 624 may be positioned on the outer sidewalls of rotating member 620. Protrusions 624 may be configured to apply forces against the inner sidewalls of rails 630 when rotating member is in the collapsed position. This may assist in maintaining rotating member 620 in the collapsed position.

Figure 7:
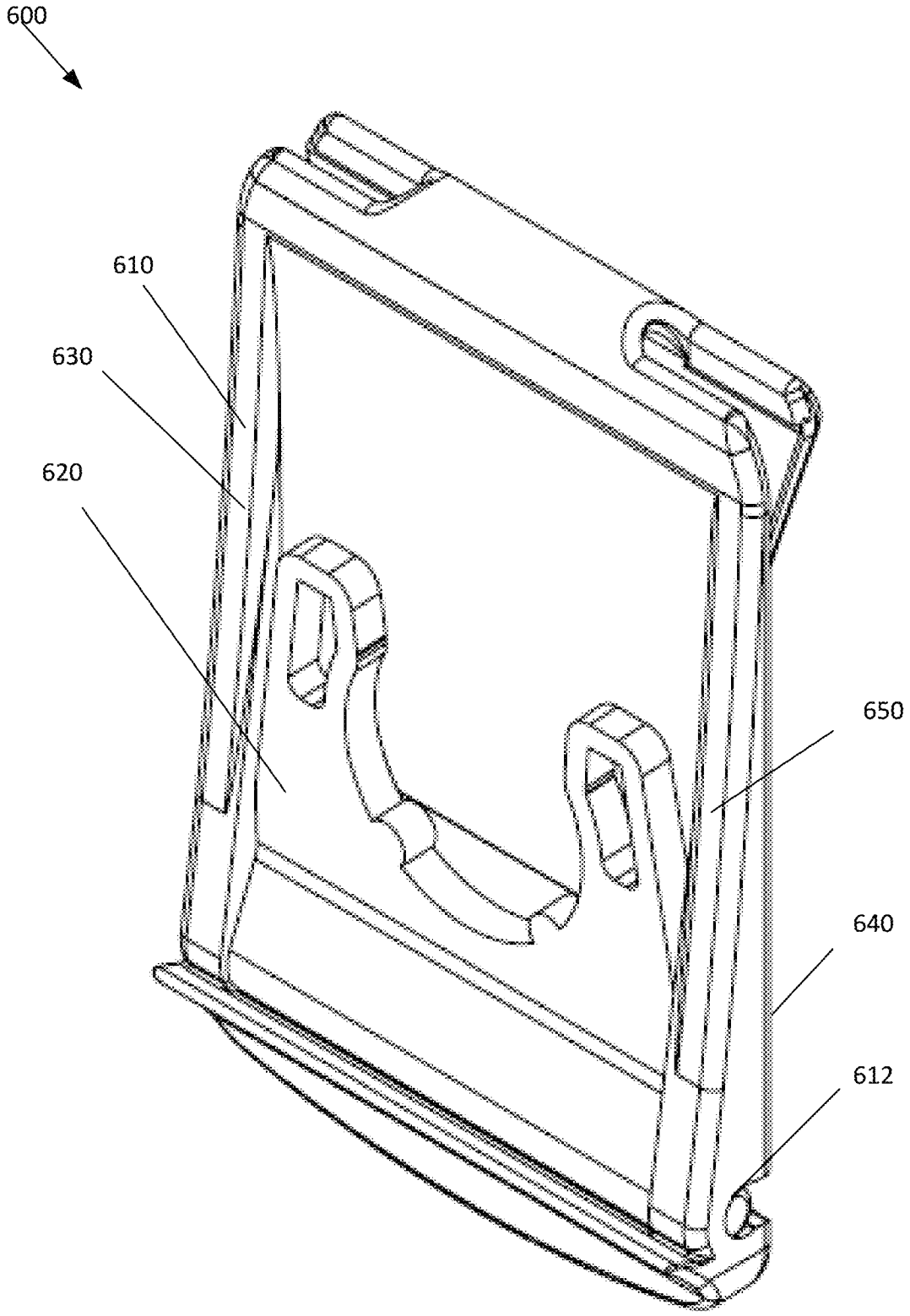
Figure 10:
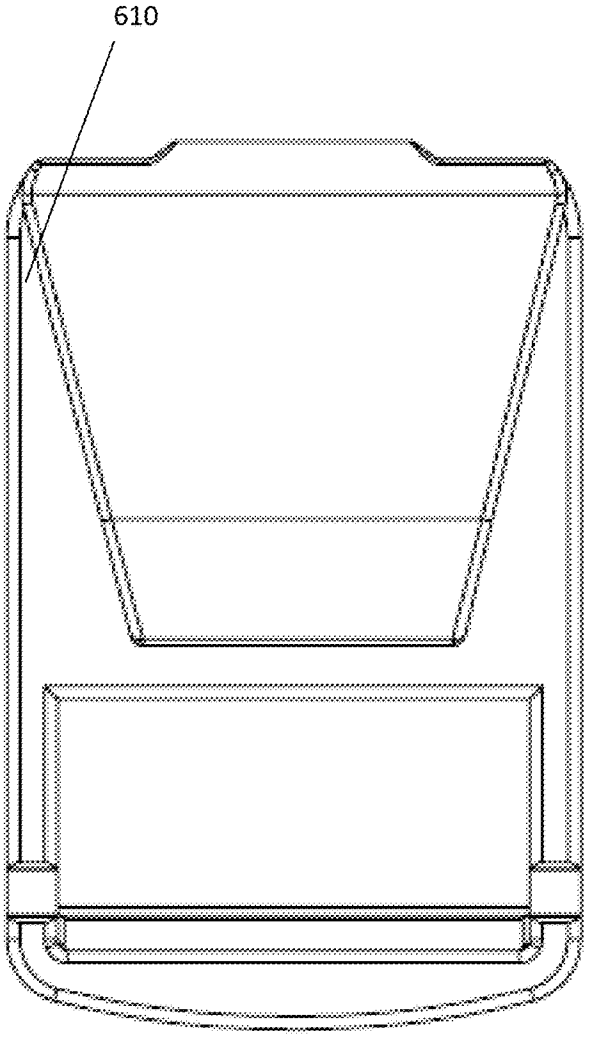
Figure 9:
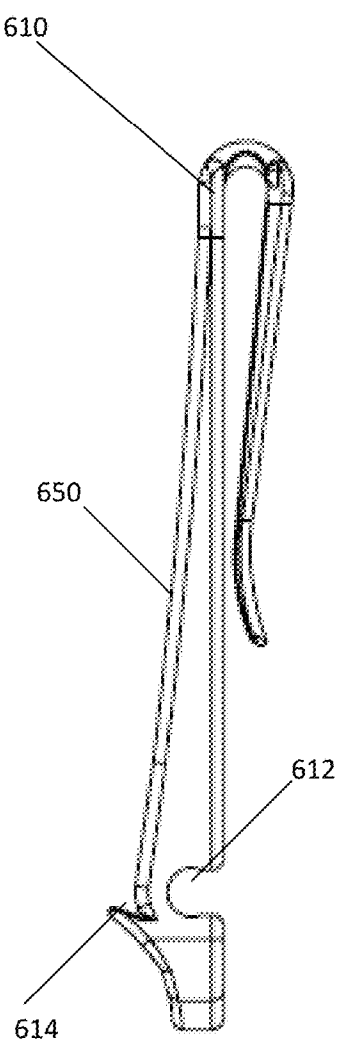
Figure 8:
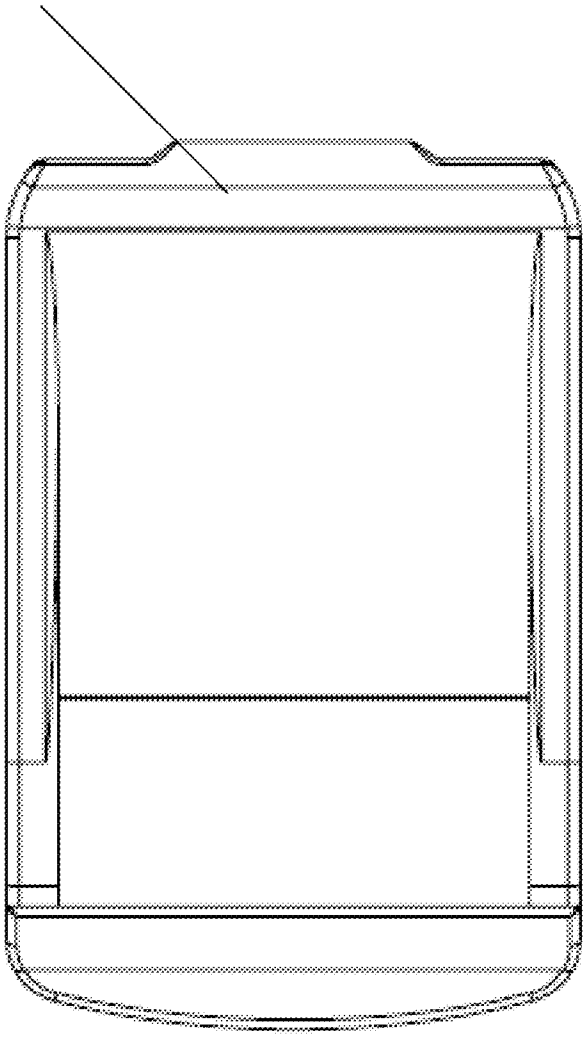
Figure 11:
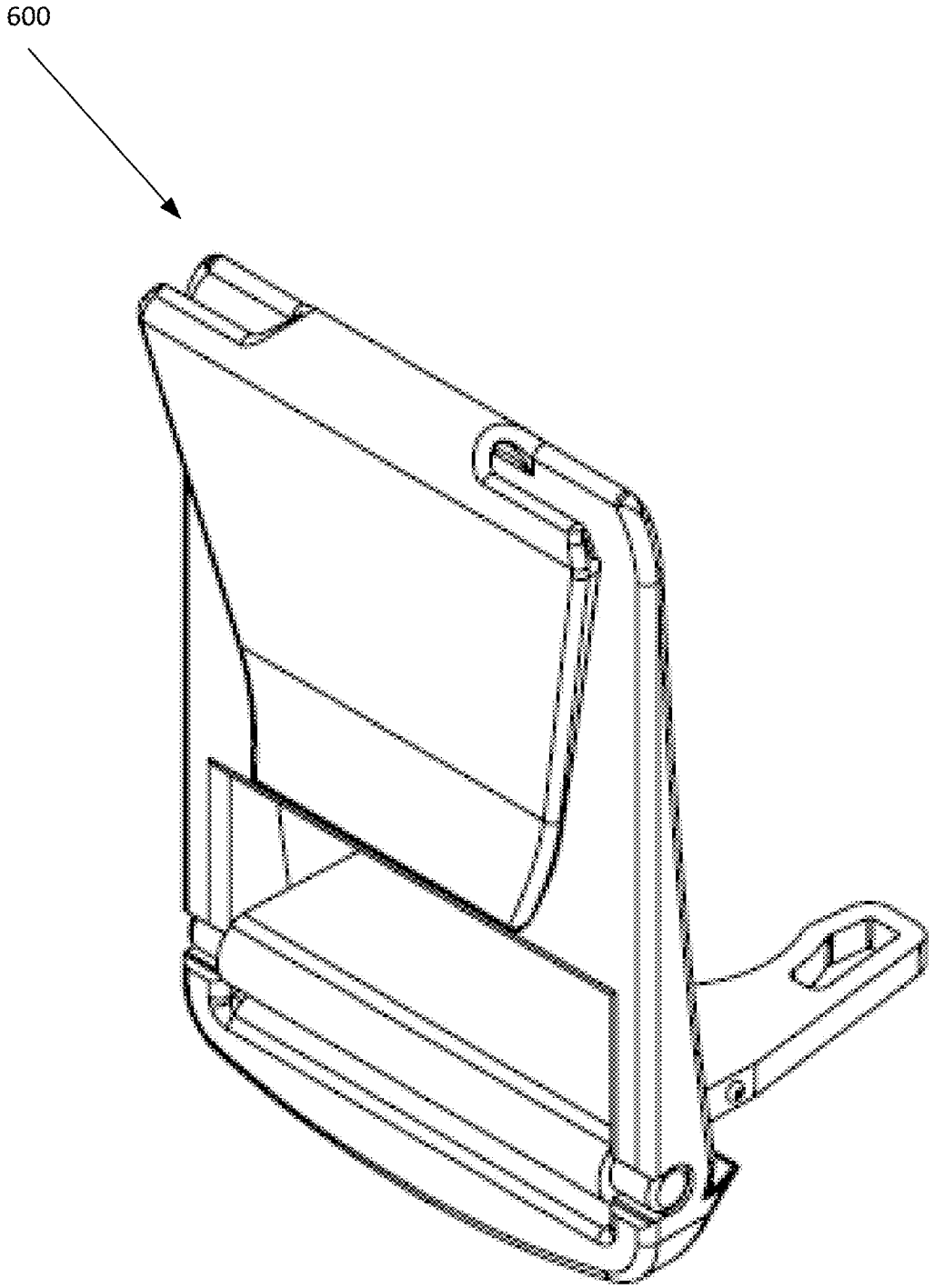
Figure 12:
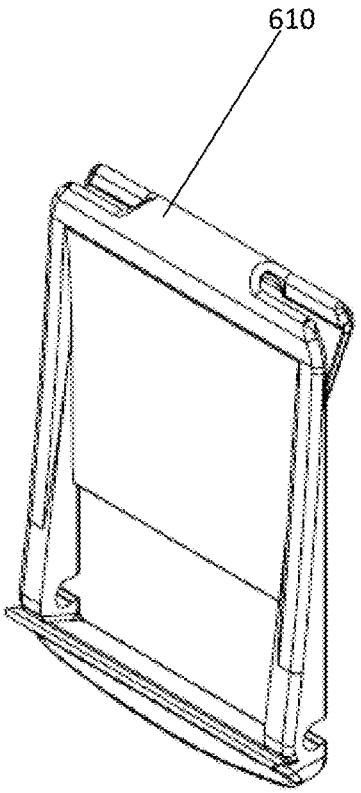
Figure 13:
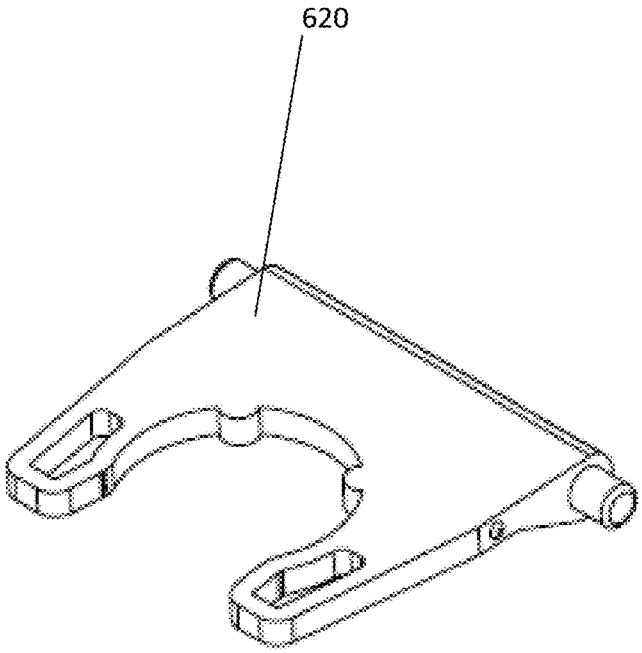
Figure 14:
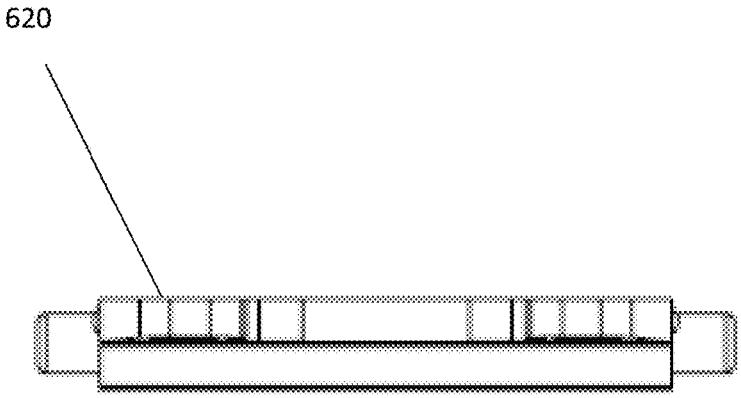
Figure 15:
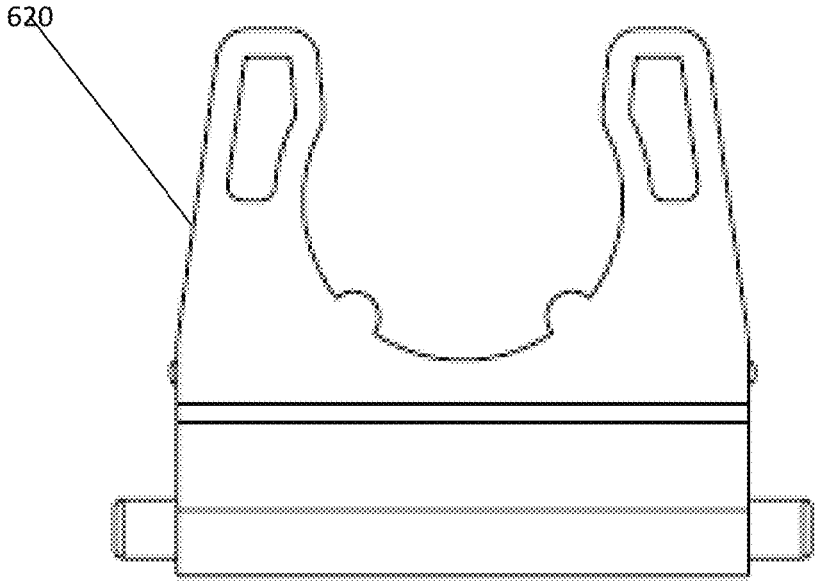
Figure 16:
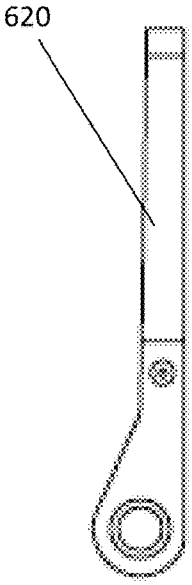

FIG. 7 depict various views of container holder 600, according to an embodiment. Elements depicted in FIG. 7 are described above. For the sake of brevity a further description of these elements is omitted.

As depicted in FIG. 7, when rotating member 620 is in the collapsed positioned, rotating member 620 may be positioned within rails 630 to minimize the profile of container holder 600.

Further, the locking grooves 612 may be positioned on rear surface 640 of rails 630 to be positioned in a direction away from the angle of rotation of rotating member 620. As such, when rotating member 620 rotates forward, locking projections 622 apply a first towards the surfaces created by locking orifices 612.

FIGS. 8-16 depict various views of container holder 600, according to an embodiment. Elements depicted in FIGS. 8-16 are described above. For the sake of brevity a further description of these elements is omitted.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A container holder comprising:

a body with rails;

locking grooves positioned on a rear surface of the rails, the locking grooves being openings having a width equal to that of the rails and extending from the rear surface of the rails towards a front surface of the rails;

a ledge positioned on the front surface of the rails, the ledge projects away from the front surface of the rails;

a rotating member configured to rotate about an axis defined by the locking grooves, wherein in a collapsed mode portions of outer sidewalls of the rotating member are configured to be positioned adjacent to inner surfaces of the rails;

locking projections positioned on the outer surfaces of the rotating member, the locking projections being configured to be removably coupled within the locking grooves by moving the locking projections in a direction perpendicular to a central axis of the body into and away from the locking grooves.

2. The container holder of claim 1, wherein the rotating member includes:

a first arm and a second arm; and a container indentation positioned between inner surfaces of the first arm and the second arm, the container indentation being an opening extending from a proximal end of the rotating member towards a distal end of the rotating member, the first arm and the second arm extending to the proximal end of the rotating member.

3. The container holder of claim 2, wherein the arms include cutouts, the cutouts being holes extending through the first arm and the second arm positioned proximal to the proximal end of the rotating member and being positioned between the inner surfaces of the first arm and the second arm and the outer surfaces of the rotating member.

4. The container holder of claim 3, wherein the container indentation includes bumps configured to increase the surface area of the container indentation.

5. The container holder of claim 4, wherein a length across the container indentation at the proximal end of the rotating member is variable based on a pressure applied to inner surfaces of the arms.

6. The container holder of claim 1, further comprising:

protrusions positioned on the outer sidewalls of the rotating member.

7. The container holder of claim 6, wherein when the rotating member is in the collapsed mode, the protrusions are positioned adjacent to inner sidewalls of the rails.

8. The container holder of claim 1, wherein the rear surface of the rails is in parallel to a central axis of the container holder, and the front surface of the rails is angled with respect to the central axis of the container holder.

9. The container holder of claim 1, wherein the ledge has an upward slope.

10. The container holder of claim 9, wherein when the rotating member is in an expanded mode the rotating member is positioned on the ledge.

11. A container holder comprising:

a body with rails;

first locking grooves positioned on inner sidewalls of the rails;

locking lips extending from front surfaces of the rails to the first locking grooves, the locking lips forming a notch on the front surfaces of the rails;

locking orifices extending through the rails from outer sidewalls of the rails to the inner sidewalls of the rails, the locking orifices being aligned with the first locking grooves and the locking lips;

a rotating member configured to rotate about an axis defined by the locking orifices, the rotating member including second locking grooves;

locks configured to be aligned with the locking orifices, the locks being configured to be positioned within the first locking grooves or the locking lips to limit the rotation of the rotating member about the axis, the locks being configured to be positioned within the second locking grooves to allow the rotating member to rotate, wherein the locks include an interface and a projection, the interface having an outer face configured to extend away from outer surfaces of the rails when the projection is positioned within the locking lips and when the projection is positioned within the first locking grooves.

12. The container holder of claim 11, wherein the locking lips and the first locking grooves are positioned perpendicular to each other, and a length of the first locking grooves is longer than that of the locking lips.

13. The container holder of claim 11, wherein outer faces of the locks are coplanar with outer surfaces of the rotating member when the locks are positioned within the second locking grooves.

14. The container holder of claim 13, wherein the outer faces of the locks are not coplanar with the outer surface of the rotating member when the locks are positioned with the second locking grooves or the locking lips.

15. The container holder of claim 11, wherein an inner surface of the projection is configured to be aligned with inner surfaces of the rail when the projection is positioned within the locking lips of the first locking grooves.

16. The container holder of claim 11, wherein the rotating member includes:

arms; and a container indentation positioned between the arms, the container indentation being an opening extending from a proximal end of the rotating member towards a distal end of the rotating member.

17. The container holder of claim 16, wherein the arms include cutouts, the cutouts being holes extending through the arms positioned proximal to the proximal end of the rotating member.

18. The container holder of claim 17, wherein the container indentation includes bumps configured to increase the surface area of the container indentation.

19. The container holder 18, wherein a length across the container indentation at the proximal end of the rotating member is variable.

* * * * *